US005564442A

United States Patent [19]

MacDonald et al.

[11] Patent Number: 5,564,442

[45] Date of Patent: Oct. 15, 1996

[54] BATTERY POWERED NICOTINE VAPORIZER

[75] Inventors: Angus C. MacDonald, 3335 Fernside Blvd., Alameda, Calif. 94501; William G. Claytor, III, San Francisco, Calif.

[73] Assignee: Angus Collingwood MacDonald, Alameda, Calif.

[21] Appl. No.: 561,704

[22] Filed: Nov. 22, 1995

[51] Int. Cl.[6] ..... A24F 47/00

[52] U.S. Cl. ..... 131/194

[58] Field of Search ..... 131/194

[56] References Cited

U.S. PATENT DOCUMENTS

| | | | |
|---|---|---|---|
| 3,863,648 | 2/1975 | Cathey | 131/194 X |
| 4,164,950 | 8/1979 | Bechtold | 131/194 |
| 4,211,244 | 7/1980 | Williams | 131/194 |
| 4,848,374 | 7/1989 | Chard et al. | 131/194 X |
| 4,917,119 | 4/1990 | Potter et al. | 131/194 X |
| 5,269,327 | 12/1993 | Counts et al. | 131/194 |
| 5,388,594 | 2/1995 | Counts et al. | 131/194 X |
| 5,479,948 | 1/1996 | Counts et al. | 131/194 |

*Primary Examiner*—William H. Grieb

*Attorney, Agent, or Firm*—Flehr, Hohbach, Test, Albritton & Herbert; Donald N. MacIntoshi

[57] ABSTRACT

A nicotine vaporizer is provided with a housing with a battery compartment size for a pair of AA dry cells and a compartment for containing tobacco, a lower portion of which has a hole for passing tobacco into a firebox cavity arranged there below and shiftable from a tobacco receiving to a tobacco burning position. Electric coil means are set in the firebox cavity and energized to bring the tobacco to combustion temperature. A mouth piece equipped suction tube extends into the housing so that as air is withdrawn through the suction tube with the coil energized the tobacco will combust as to the microcharge contained in the firebox cavity. The microcharge of tobacco is of such volume that no more smoke is created than can be processed by the lungs in one breath.

8 Claims, 3 Drawing Sheets

BATTERY POWERED NICOTINE VAPORIZER

BACKGROUND OF THE INVENTION

This invention relates to tobacco smoking and more particularly to an improved apparatus and method serving to achieve the effect of smoking without releasing second hand smoke into the surrounding area.

Tobacco was in use in the New World well before the arrival of Christopher Columbus. It is normally smoked in cigarettes or in a pipe or chewed or used in powder form as snuff. All of these modes of using tobacco are distasteful in some way or other, especially to non-smokers, due to second hand smoke, spitting of tobacco and its juices, etc. An important constituent of tobacco, nicotine, is also available as a drug and may be delivered in a chewable gum or as an arm patch, both by a physician's prescription. These systems for delivering the nicotine are not distasteful and they assist smokers to quit using tobacco but they are not satisfying as there is no associated pleasure as when the concentration of nicotine rises sharply in the bloodstream. The rapid transfer of any substance into the bloodstream is most quickly effected by a directed injection and inhalation is a close second, with eating and transdermal absorption tied for third place for speed of transfer. Often the rate at which the bloodstream concentration rises is critical to the perceived effect. This is why it is often difficult for cigarette smokers to switch to any other form of nicotine delivery. Cigarette smoke, unlike pipe or cigar smoke, is fully inhaled into the lungs so the effect is felt almost immediately. An unfortunate side effect of smoking cigarettes is that the smoker inhales into the lungs tars and other products of combustion which are subsequently exhaled as "second hand smoke". There is ample documentation that the smoking of cigarettes as well as prolonged exposure to second hand smoke makes the human body vulnerable to emphysema, heart disease and cancer.

Electric heating of tobacco for smoking is well known. U.S. Pat. No. 5,269,327 issued Dec. 14, 1993 to Mary E. Counts, et al. discloses a cigarette shaped article containing a plurality of charges of tobacco flavored medium equal to an average number of puffs per cigarette. The charges are individually heated electrically as the smoker puffs on the unit. The complexity of this device as well as the need for specialized tobacco charges are serious practical drawbacks.

It would be preferable if a compact and easy to use smoking article could employ tobacco in commonly available forms such as that provided for cigarettes, pipe tobacco, etc.

SUMMARY OF THE INVENTION AND OBJECTS

In accordance with this invention, there is provided a nicotine vaporizer for delivering to a consumer a volume of vapor containing nicotine, not more than the capacity of the consumer's lungs, derived from a microcharge of tobacco. The vaporizer comprises a housing configured in size to fit comfortably in the user's hand and serving to mount therein an electric battery power source. A compartment within the housing contains a supply of tobacco for consumption with the tobacco being metered into a firebox member having a cavity for receiving a microcharge of tobacco. An air suction tube extends into the housing with the inner end proximate to the firebox and electrical resistance wire means are arranged in the firebox cavity for engagement with the microcharge of tobacco. An electric circuit couples the resistance wire means with the power source for heating the microcharge of tobacco to a temperature serving to vaporize the nicotine such that the user's suction breath applied through the suction tube removes the nicotine vapors from the housing resulting from the tobacco's heating.

An object of the invention is to provide an electrical smoking article which operates to combust a microcharge of tobacco to produce a relatively consistent volume with each puff.

Another object of the invention is to provide such an article which consistently for each puff reaches its operating temperature quickly and remains at that temperature long enough to release the desired nicotine vapor while at the same time minimizing the consumption of energy.

Another object of the invention is to provide such an article which is self contained.

A further object of the invention is to provide such an article which has an appearance unlike a conventional cigarette or pipe and which generates neither second-hand smoke nor exterior ash, and is not hot between puffs.

A further object of the invention is to allow a smoker to achieve the pleasurable effects of smoking without annoying other people nearby or in locations where smoking is reserved.

Yet another object of the invention allows a cigarette smoker to enjoy the flavor of cigarette tobacco without expelling harmful or offensive smells such that when a person seated adjacent to a user of our invention will not be harmed even though such person may be allergic to cigarette smoke.

We have observed in the prior art for alternative smoking devices a good deal of effort has been made to avoid burning the tobacco with the objective to vaporize the nicotine having a boiling point of about 246° C. This we believe to be neither necessary or a useful step to avoid creation of second hand smoke. Second hand smoke is that smoke which a cigarette emits when it is not being inhaled upon as well as that smoke which remains in a smoker's windpipe and mouth following inhalation. Smoke which actually flows into the smoker's lungs is effectively filtered by the vast surface area of the lungs and is retained there. Thus it is an object of our invention that we provide a quantity of tobacco for burning whose smoke can be held in the lungs and contained entirely therein with no offensive vapor created upon exhalation.

Another object of the invention is to provide a nicotine vaporizer which meters the tobacco so that the puff of smoke created each time is no more than the lungs can process in one breath.

A further object of the invention is to provide a device of the type described which will deliver to the user just enough tobacco smoke to fill the lungs with each puff, the smoke produced giving the enjoyable effect to the user while preserving a smoke-free environment for bystanders.

Yet another object of the invention is to provide a device of the type described which is sized to fit the hands and has a general configuration and dimension of the conventional package of cigarettes.

The above and other objects and advantages of the invention will be apparent upon consideration of the following detailed description taken in conjunction with the accompanying drawings.

DETAILED DESCRIPTION OF THE PREFERRED EMBODIMENT

Figure 1:
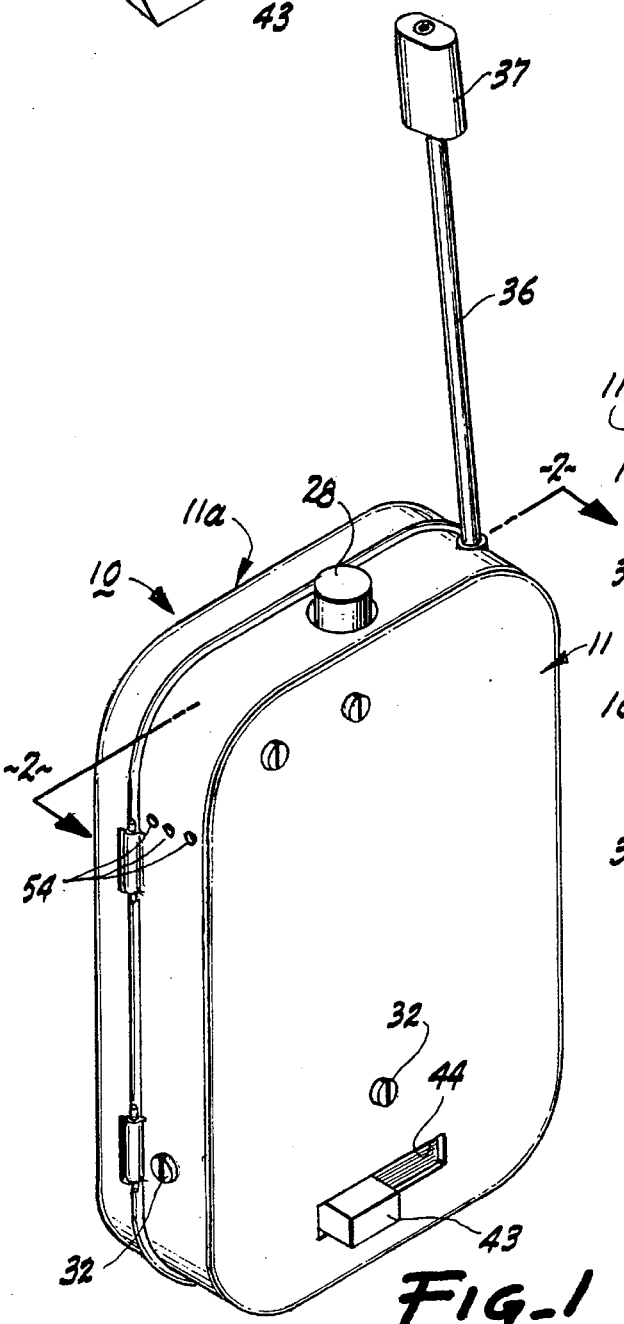
FIG. 1 is a perspective view of the battery powered nicotine vaporizer of the present invention.
Figure 2:
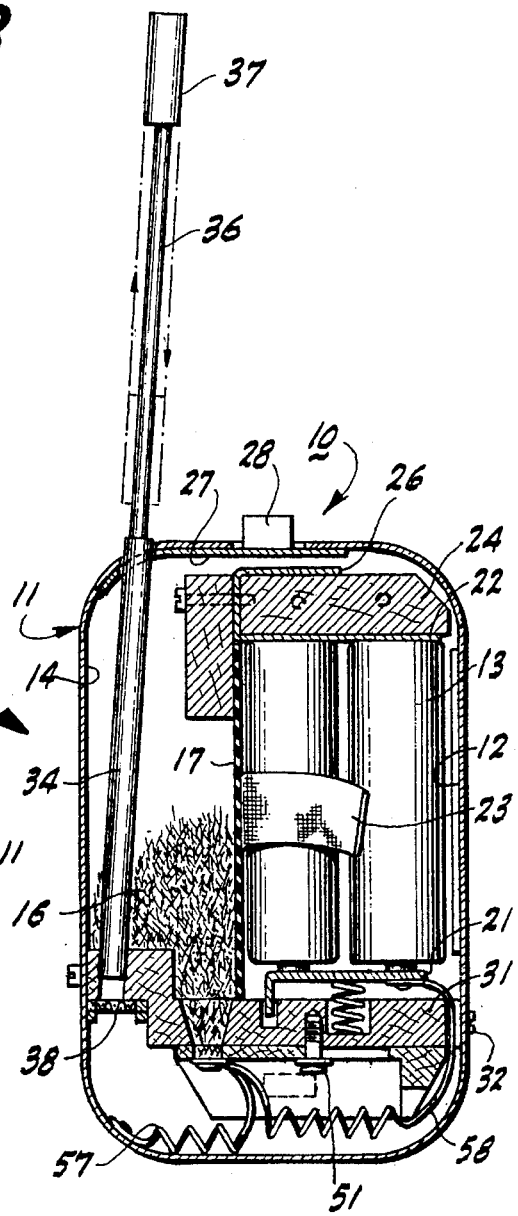
FIG. 2 is a sectional view taken in the direction of the arrows 2—2 in FIG. 1 but on a somewhat smaller scale and illustrating the vaporizer with its contents in place.
Figure 3:
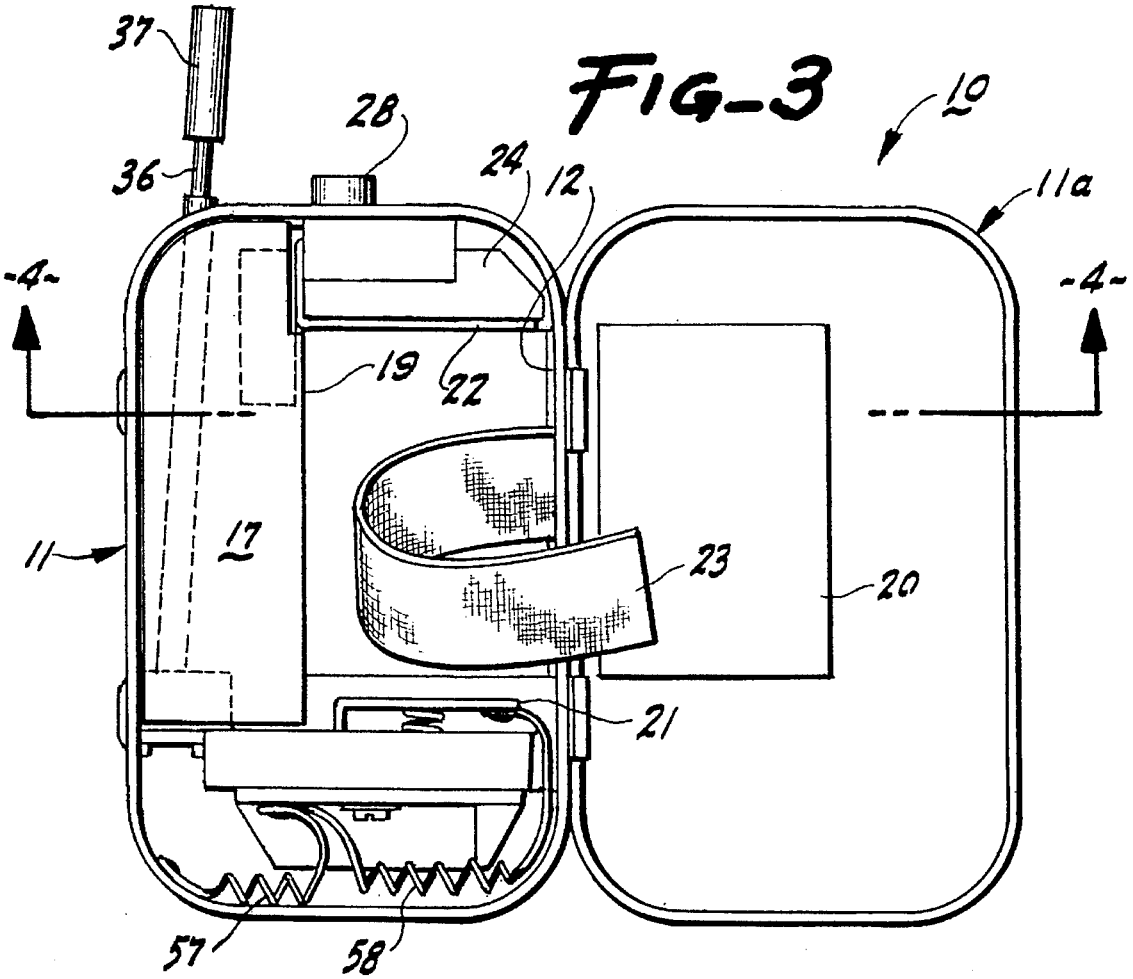
FIG. 3 is an elevational view of the nicotine vaporizer of FIG. 1 shown in the "open door contents removed condition"
Figure 4:
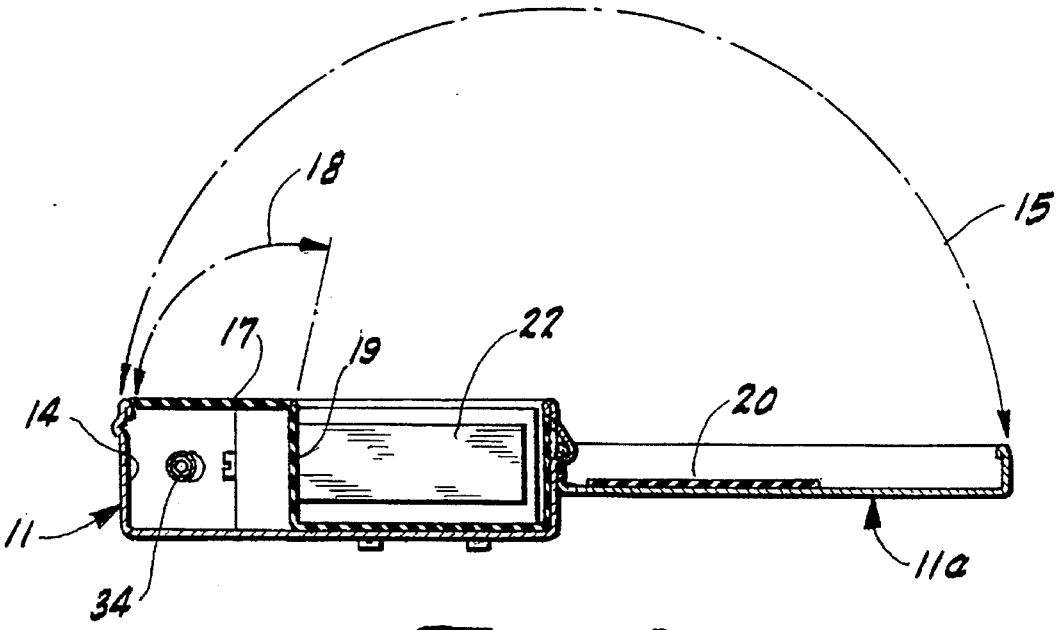
FIG. 4 is a sectional view taken in the direction of the arrows 4—4 in FIG. 3.

A battery powered nicotine vaporizer 10 made in accordance with and embodying the principles of the present invention is shown in FIGS. 1, 2 and 3 of the drawings. The nicotine vaporizer 10 includes a housing 11 containing a compartment 12 fitting a pair of AA size batteries 13 and a compartment 14 for receiving and holding a supply of tobacco 16. As shown in FIGS. 3 and 4, the housing 11 is equipped along one side with a closure or door 11*a* facilitating introduction of the batteries 13 and tobacco 16 into their respective compartments. The tobacco compartment 14 is also equipped with a pivotable closure door 17 with its open condition indicated in FIG. 4 by the broken line and arrows 18.

Preferably the housing 11 is fabricated from a metallic material so as to be electrically conductive being that the housing serves in the circuit which uses the power from the AA cells 13, arranged in parallel, to heat the tobacco in a manner to be discussed below to a combustion temperature. The closure 11*a* of the housing pivots to the open condition as shown in FIG. 4 and as indicated by the broken line and arrows 15. The closed position is shown in FIG. 1.

The battery compartment 12 is configured to retain snugly the batteries 13 and to this end there is provided a medial partition 19 arranged as shown in FIGS. 2 and 4, an electrically insulating spacer member 20, a spring mounted lower battery support 21 and an upper battery support 22. The battery supports 21 and 22 are formed from electrically conductive materials such as copper, brass or aluminum as is well understood by those skilled in the field and a flexible fabric strap 23 serves to assist in the removal of the batteries from their snug fit within the compartment 12. A non-conductive spacer member 24 arranged above the upper battery support 22 is provided with a conductive contact plate 26 positioned for engagement with a second contact plate 27 fixed at one end only to the housing 11 so as to be resiliently biased to remain out of contact with the first contact plate 26 when not urged there against through a finger-force applied through an actuation button 28, shown best in FIGS. 1 and 2. It will be understood that when the actuation button 28 is pressed the second contact plate 27 pivots into contact with the first contact plate 26 which is in circuit with the negative terminals of the battery pair 13.

Figure 5:
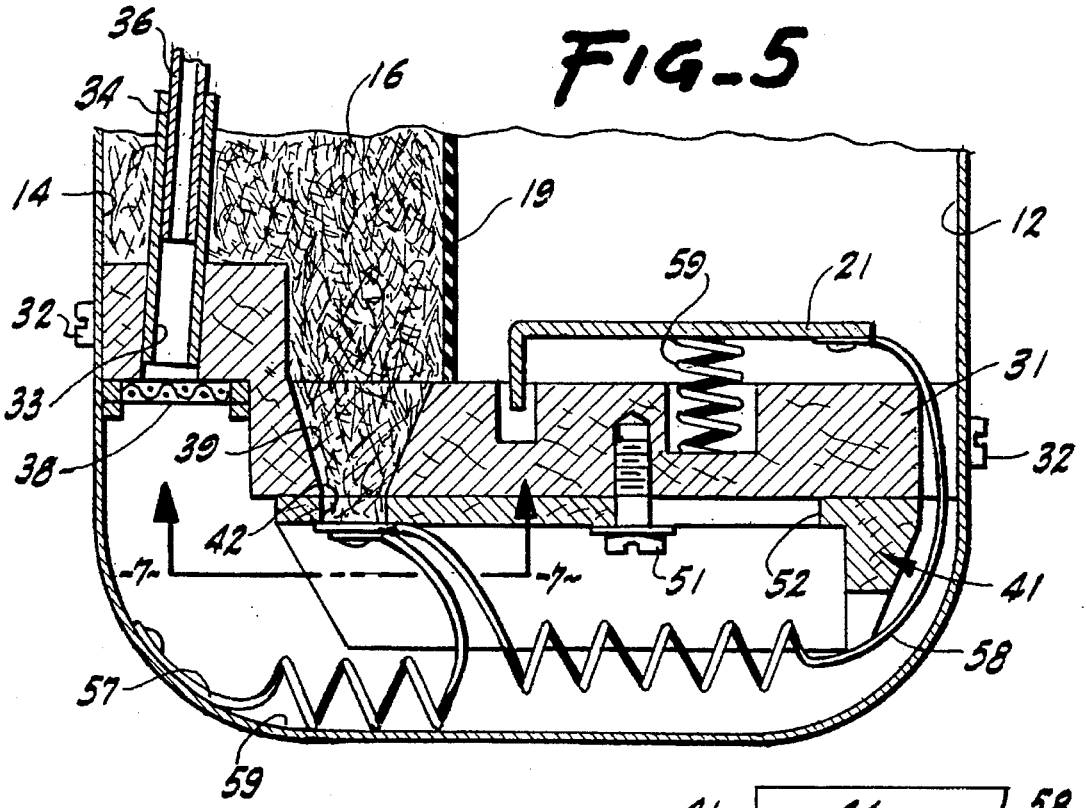
FIG. 5 is an enlarged fragmentary sectional view of the lower portion of the vaporizer shown with the electric batteries removed and the firebox carrying slider member in the position for tobacco charging.
Figure 6:
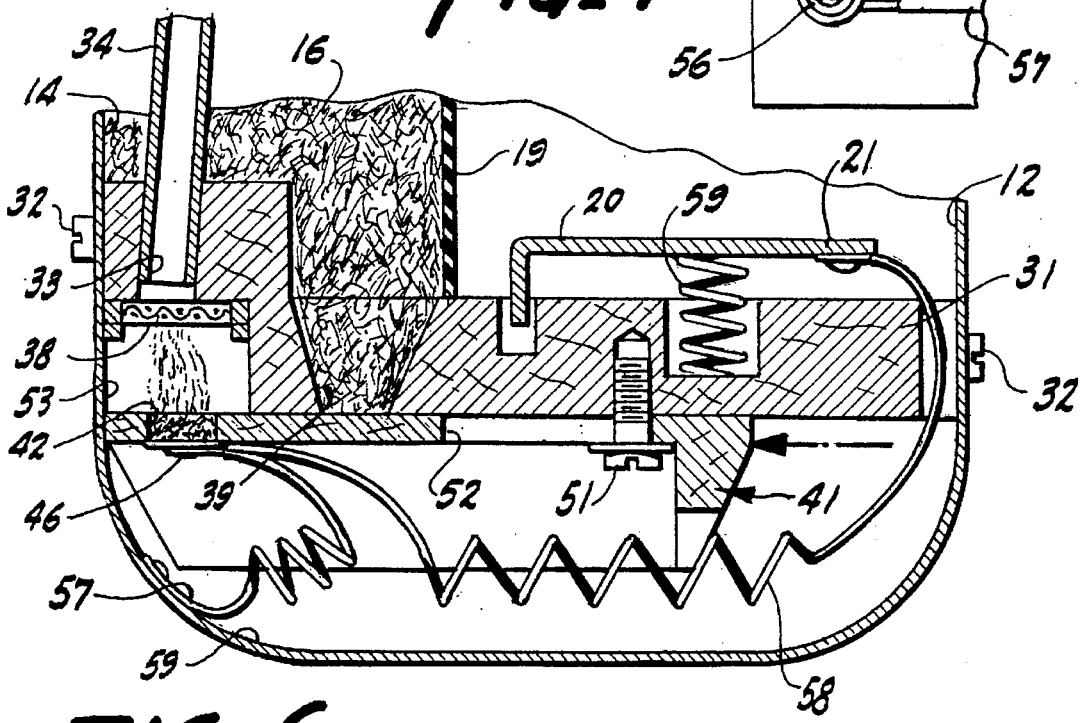
FIG. 6 is a view like FIG. 5 but with the firebox carrying slider member positioned in the condition for tobacco burning.

A bulkhead 31 formed from non-conductive materials extends laterally of the housing 11 and defines the lower portion of the tobacco compartment 14, as shown in FIGS. 2, 5 and 6. The bulkhead 31 may be secured to the side walls of the housing 11 by fasteners 32. A vertical bore 33 extends between upper and lower surfaces of the bulkhead 31 and serve to receive a lower suction tube 34 which extends therefrom upwardly through the top wall of the housing 11, as shown in FIG. 2. An upper suction tube 36 equipped with a wooden mouth piece 37 is slidably received within the lower suction tube 34 in a substantially air-tight fit and as to be movable between an extended position as shown in FIGS. 1 and 2 to a retracted or out of the way position as shown in FIG. 3.

Figure 8:
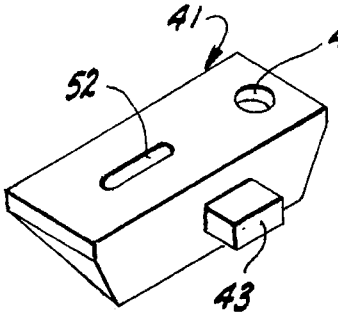
FIG. 8 is an enlarged perspective view of the firebox carrying slider member.
Figure 7:
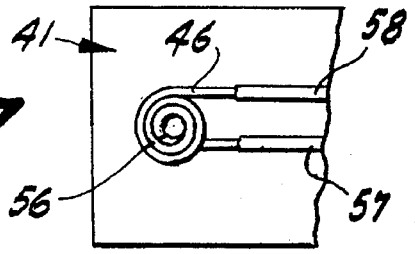
FIG. 7 is a view of the firebox carrying slider member taken in the direction of the arrows 7—7 in FIG. 5.

At the lower end of the bore 33 and downwardly from the end of the lower suction tube 34 a screen 38 is mounted in an associated recess in the bulkhead 31, as shown in FIGS. 5 and 6. The purpose of the screen 38 is to prevent burning embers from being sucked into the lower suction tube 34. A funnel-shaped tobacco delivery hole 39 is formed between the upper and lower surfaces of the bulkhead 31 so that by an external tap, tap, tap impulse tobacco may be urged downwardly through the delivery hole 39 into a slider member 41 so as to charge a firebox cavity 42 arranged therein. The tobacco delivery hole 39 is tapered preferably from about one centimeter at the top to about 5 mm diameter at the bottom so that if the slider member 41 is moved so that the firebox 42 is in registration therewith, tobacco falls through into the firebox fairly readily. The firebox 42 is preferably about 4 mm in diameter and about 2 mm deep and holds a microcharge of tobacco on the order of 3 mg. The slider 41 is preferably formed from a hard wood such as a maple burl from which pipe bowls are normally formed. A tongue 43 extends outwardly from a wall of the slider, as shown in FIG. 8, and is adapted to protrude from the housing 11 through a slot 44 arranged in one wall thereof, FIG. 1. The slot 44 forms a guideway for movement of the tongue when shifting the slider from the position of FIG. 5 for loading tobacco in the firebox 42 to the position shown in FIG. 6 where the tobacco in the firebox 42 is caused to combust by the heating coil 46 shown in FIG. 7. The slider 41 is guided in its movements along the bulkhead 31 by means of a bolt and washer 51 mounted in a slot 52 and secured at its end into the bulkhead 31 as shown in FIGS. 5 and 6. The bolt 51 ensures that the slider remains in contact with the bulkhead 31 in both the tobacco receiving and tobacco burning positions.

A combustion chamber 53 is defined at its bottom by the slider member 41 is in the position as indicated in FIG. 6 with the combustion chamber in communication through the screen 38 with the suction tube 34. A current of air is supplied into the combustion chamber 53 when a user is sucking air through the mouth piece 37, there being a plurality of apertures 54 in the wall of the housing 11 so that a draft of outside air enters the housing through the apertures 54 and course through the battery compartment 12 to the combustion chamber 53, the apertures 54 being clearly shown in FIG. 1.

It will be understood that the heater coil 46 mounted in the firebox 42 forms the grate of the combustion chamber 53 and the coil is formed preferably from a high resistance wire such as 0.4 mm diameter nichrome wire of about 2.5 cm in length. The heater coil 46 is wound into a tight double coil 56 and is coupled to an insulated copper conductor 57 which is grounded to the metallic housing 11 as shown in FIGS. 5 and 6. A second lead 58 from the coil 46 is in electrical contact with the lower battery support 21 which is held vertically from the bulkhead 31 by the spring 59. Pressure applied to the outside button 28 will cause the contact plate 27 to be depressed into engagement with contact plate 26 which is in circuit with the negative terminals of the batteries 13 thus supplying current to the heater coil 46 for combustion of the microcharge of tobacco for inhalation to the extents of approximately just less than the full lungful by the user of the vaporizer 10.

To use our invention, the smoker first extends the upper suction tube 36 from the housing and then shifts the protruding tongue 43 to the position shown in FIG. 1 wherein the slider 41 and the firebox 42 is positioned below the tobacco delivery hole 39. The smoker taps the unit 10 once or twice which causes tobacco leaves 16 to fall into the firebox 42 to the extent of approximately 3 mg. The smoker uses the tongue 43 to shift into the position at the end of the slot 44 thus moving the firebox to define a combustion chamber under the lower suction tube 34. The smoker then presses the button 28, pauses for a short period to preheat the charge, and then sucks on the mouthpiece 37. The heating coil 46 heats the charge in the combustion chamber as an air current moves past and through it and past the wire mesh screen caused by the smoker's inhalation through the screen 38 and suction tubes 34, 36. As the temperature of the tobacco leaves rise, water and other volatile organic compounds including nicotine vaporize. This is the beginning of smoke. Eventually combustion will occur but only if the smoker desires. Heating can be controlled by the smoker manipulating the button 28 and it should be noted here that since tobacco leaves only burn at the end of the process, the nicotine is already driven off by the time combustion occurs. Thus efficient and effective delivery of the nicotine is effected to the lungs. In ordinary cigarettes a substantial amount of nicotine just serves as fuel and burns partially creating noxious tars. In the vaporizer subject of the present invention, most of the nicotine reaches the lungs pure and in an unburned state.

When the smoker has finished the puff, he turns the vaporizer and taps the side nearest the suction tube. This empties the spent tobacco or ash into the ash pan cavity 59 below the bulkhead 31. The smoker then moves the tongue 43 to the position shown in FIG. 1 and taps the bottom of the unit to refill the firebox cavity with leaves. The vaporizer is now ready to provide the next puff.

While a particular embodiment of the present invention has been illustrated and described, it will be obvious to those skilled in the art that various changes and modifications can be made without departing from the spirit of the scope of the invention. It is intended to cover in the appended claims all such modifications that are within the scope of this invention.

What is claimed is:

1. A nicotine vaporizer comprising, a housing configured and sized to fit comfortably in the user's hand during use, said housing having therein a first compartment serving to contain an electric battery power source, said housing having therein a second compartment serving to contain a supply of tobacco and having an aperture in a lower portion thereof for passing tobacco there through, a firebox member arranged in said housing proximate said second compartment and being shiftable from a first position for receiving a micro charge of tobacco through said aperture to a second position wherein said firebox member occludes said aperture, an air suction tube mounted upon and extending into said housing, the distal end of said suction tube being arranged and disposed for receiving vapors from said firebox when it is in said second position, said firebox member including a cavity sized to receive a micro charge of tobacco, electrical resistance wire means arranged in said firebox cavity for engagement with such tobacco charge therein, electric circuit means coupling said resistance wire means with said power source and including switch means selectable to provide current to said electrical resistance means to heat a micro charge of tobacco in said cavity to a combustion temperature, said housing having at least one air admitting opening therein in communication with said firebox cavity, whereby the user's suction breath applied through said mouthpiece and suction tube serves to remove from the housing the combustion vapors.

2. The nicotine vaporizer of claim 1 wherein actuator means accessible to the user's fingers from outside said housing permit operation of said switch means and for engaging said firebox member for movement between said first and second positions.

3. The nicotine vaporizer of claim 1 wherein said first compartment is configured to contain a pair of AA size dry cell batteries, said electric circuit means being configured to bring said resistance wire to tobacco burning temperature with such dry cell batteries arranged in parallel.

4. The nicotine vaporizer of claim 1 wherein a closure is pivotally mounted on said housing for ready access to said first and second compartments for supplying and removing the contents thereof and for removing any residue from said firebox cavity.

5. The nicotine vaporizer of claim 1 wherein the suction tube includes two telescopically related tubes, the proximal end of said suction tube being provided with a mouthpiece.

6. A nicotine vaporizer comprising, a housing, an electric battery power source associated with said housing, said housing having therein a compartment serving to contain a supply of tobacco and having an aperture in a lower portion thereof for passing tobacco there through, a firebox member arranged in said housing proximate said second compartment and being shiftable from a first position for receiving a micro charge of tobacco through said aperture to a second position wherein said firebox member occludes said aperture, an air suction tube mounted upon and extending into said housing, the distal end of said suction tube being arranged and disposed for receiving vapors from said firebox when it is in said second position, said firebox member including a cavity sized to receive a micro charge of tobacco, electrical resistance wire means arranged in said firebox cavity for engagement with such tobacco charge therein, electric circuit means coupling said resistance wire means with said power source and including switch means selectable to provide current to said electrical resistance means to heat a micro charge of tobacco in said cavity to a combustion temperature, said housing having at least one air admitting opening therein in communication with said firebox cavity, whereby the user's suction breath applied through said mouthpiece and suction tube serves to remove from the housing the combustion vapors.

7. A process for controlling the dose of a substance vaporized from its solid form to be absorbed into a person's lungs so that no more of such substance is available for an inhalation than can be normally held within a fractional volume of the person's lungs whereby little if any of such substance's vapor will be wasted or an excess vapor exhaled, comprising the steps providing a housing with a closure and having first and second compartments therein, providing a supply of such substance in its solid form to said first compartment, providing electric battery means to said second compartment connected in circuit to electric heating means providing means for receiving and metering discrete small doses of such substance from the supply thereof in said first compartment, actuating the electric heating means for heating zone containing the metered dose of such substance to its vaporized state, said housing including a suction tube communicating with said zone serving to permit the user's breath inhalation to remove the substance vapor from within the housing, and inhaling through said suction tube while heating the metered dose of such substance.

8. The process of claim 7 in which the substance is tobacco.

* * * * *